US009080432B2

(12) United States Patent
Yang et al.

(10) Patent No.: US 9,080,432 B2
(45) Date of Patent: Jul. 14, 2015

(54) ENERGETIC MATERIAL APPLICATIONS IN SHAPED CHARGES FOR PERFORATION OPERATIONS

(75) Inventors: Wenbo Yang, Sugar Land, TX (US); Lawrence A Behrmann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/878,138

(22) Filed: Sep. 9, 2010

(65) Prior Publication Data

US 2011/0056362 A1 Mar. 10, 2011

Related U.S. Application Data

(60) Provisional application No. 61/241,089, filed on Sep. 10, 2009.

(51) Int. Cl.
*F42B 12/00* (2006.01)
*E21B 43/117* (2006.01)
*F42B 1/02* (2006.01)

(52) U.S. Cl.
CPC ..... *E21B 43/117* (2013.01); *F42B 1/02* (2013.01)

(58) Field of Classification Search
CPC ..... E21B 43/116; E21B 43/117; F42B 1/02
USPC ..... 102/305, 306, 476; 89/1.15
See application file for complete search history.

(56) References Cited

U.S. PATENT DOCUMENTS

| | | | | |
|---|---|---|---|---|
| 3,948,181 | A * | 4/1976 | Bergstrom | 102/476 |
| 4,705,582 | A * | 11/1987 | Aubert | 149/92 |
| 5,859,383 | A | 1/1999 | Davison et al. | |
| 6,591,911 | B1 * | 7/2003 | Markel et al. | 166/297 |
| 7,752,972 | B1 * | 7/2010 | Baker et al. | 102/309 |
| 2003/0037692 | A1 * | 2/2003 | Liu | 102/301 |
| 2009/0078144 | A1 | 3/2009 | Behrmann et al. | |
| 2009/0078420 | A1 | 3/2009 | Caminari et al. | |

FOREIGN PATENT DOCUMENTS

WO 2005035939 A1 4/2005

* cited by examiner

*Primary Examiner* — Gabriel Klein
(74) *Attorney, Agent, or Firm* — Jeffery R. Peterson; Brandon Clark

(57) ABSTRACT

A shaped charge includes a cup-shaped casing defining an interior volume; a liner located within the interior volume; an explosive disposed between the liner and the casing; and a reactive material disposed between the liner and the casing. A method for generating a dynamic overbalance inside a wellbore includes disposing a perforation gun in the wellbore; and detonating a shaped charge in the perforation gun, wherein the shaped charge includes a cup-shaped casing defining an interior volume, a liner located within the interior volume, an explosive disposed between the liner and the casing, and a reactive material disposed between the liner and the casing.

7 Claims, 4 Drawing Sheets

ENERGETIC MATERIAL APPLICATIONS IN SHAPED CHARGES FOR PERFORATION OPERATIONS

CROSS-REFERENCE TO RELATED APPLICATIONS

This application claims the benefit of U.S. Provisional Patent Application Ser. No. 61/241,089 filed on Sep. 10, 2009. This provisional application is incorporated by reference in its entirety.

BACKGROUND

1. Technical Field

The present application relates generally to perforating technology, and more specifically to shaped charges including reactive materials.

2. Background Art

To complete a well, one or more formation zones adjacent a wellbore are perforated to allow fluids from the formation zones to flow into the wells for production to the surface or to allow injection fluids to be applied into the formation zones. In a perforation operation, a perforating gun string may be lowered into the wellbore and the guns fired to create openings in the casing and to extend perforations into the surrounding formation.

To produce more hydrocarbons from tight formations, fracturing may be needed to open up these perforations. For example, fracture fluids, which may contain proppants, may be forced with high pressure into the formations to open the fissures. For carbonate formations, acid treatments may be used to achieve the same purpose by dissolving the carbonates. As a result, cracks and pores of the rock around the wellbore are opened up, allowing the formation fluids, e.g., gas, oil, and water, to flow into the wellbore.

FIG. 1 illustrates an embodiment of well treatment system 8, which may include a perforating gun 21, an applicator tool 24, and a surge tool 10. The perforating gun 21 is used to create perforation tunnels 18 in formation 16. The applicator tool 24 may be used to apply treatment fluids (e.g., fracturing fluids or completion fluids) in the perforation tunnels 18. The application of the treatment fluids may be controlled by a timer 23 or other mechanisms.

Perforating gun 21 includes perforating charges 26 that are activatable to create perforation tunnels 18 in formation 16 surrounding a wellbore interval and casing 20. Perforating gun 21 can be activated by various mechanisms, such as by a signal communicated over an electrical conductor, a fiber optic line, a hydraulic control line, or other type of conduit.

Well treatment system 8 may further include an applicator tool 24 for applying a treatment fluid (e.g., acid, chelant, solvent, surfactant, brine, oil, enzyme and so forth, or any combination of the above) into the wellbore 12, which in turn flows into the perforation tunnels 18. The treatment fluid applied can be a matrix treatment fluid. Upon opening of a port 27, the pressurized fluid is communicated into the surrounding wellbore interval.

The surge tool 10 may be used to create a local transient underbalance condition, which will facilitate removal (wash out) debris that may damage the tunnels 18. Surge tool 10 typically contains surge charges, which, when detonated, generate penetrations 25 through the wall of housing 22. The penetrations 25 allow the inside of the surge tool 10 to be in fluid communication with fluids in the wellbore. Because the surge tool 10 has a lower internal pressure than that of the wellbore, it creates a dynamic underbalance when the well fluids flow into the surge tool 10. For description of surge tools, see for example U.S. Pat. No. 7,428,921, issued to Grove et al., the entirety of which is incorporated herein by reference.

In fracturing operations, dynamic overbalance may be desirable for generating deeper and larger perforating tunnels, which would facilitate subsequent fracturing or acid treatment in Sandstone, Carbonate and Coal formations, leading to better production.

SUMMARY

One aspect of preferred embodiments relates to shaped charges. A shaped charge in accordance with one embodiment includes a cup-shaped casing defining an interior volume; a liner located within the interior volume; an explosive disposed between the liner and the casing; and a reactive material disposed between the liner and the casing.

Another aspect relates to methods for generating a dynamic overbalance inside a wellbore. A method in accordance with one embodiment includes disposing a perforation gun in the wellbore; and detonating a shaped charge in the perforation gun, wherein the shaped charge includes a cup-shaped casing defining an interior volume, a liner located within the interior volume, an explosive disposed between the liner and the casing, and a reactive material disposed between the liner and the casing.

Other aspects and advantages of preferred embodiments will be apparent from the following description and the appended claims.

DETAILED DESCRIPTION

Preferred embodiments relate to perforation apparatus and methods for generating a dynamic overbalance in perforation operations. Particularly, embodiments relate to shape charges that are capable of generating dynamic overbalance upon detonation. Dynamic overbalance is a condition, in which the pressures in the wellbore are transiently higher than the pressures in the formations. In accordance with embodiments, the dynamic overbalance can be created by the use of reactive materials that can generate heat upon detonation. A "reactive material" as used herein refers to a material other than an explosive that is conventionally used in a shaped charge.

Embodiments may be used in inland or offshore applications and in any wellbore formations. The following description discusses several exemplary embodiments and is meant to provide an understanding to one skilled in the art. The description, therefore, is not in any way meant to limit the scope of any present or subsequent related claims.

Figure 1:
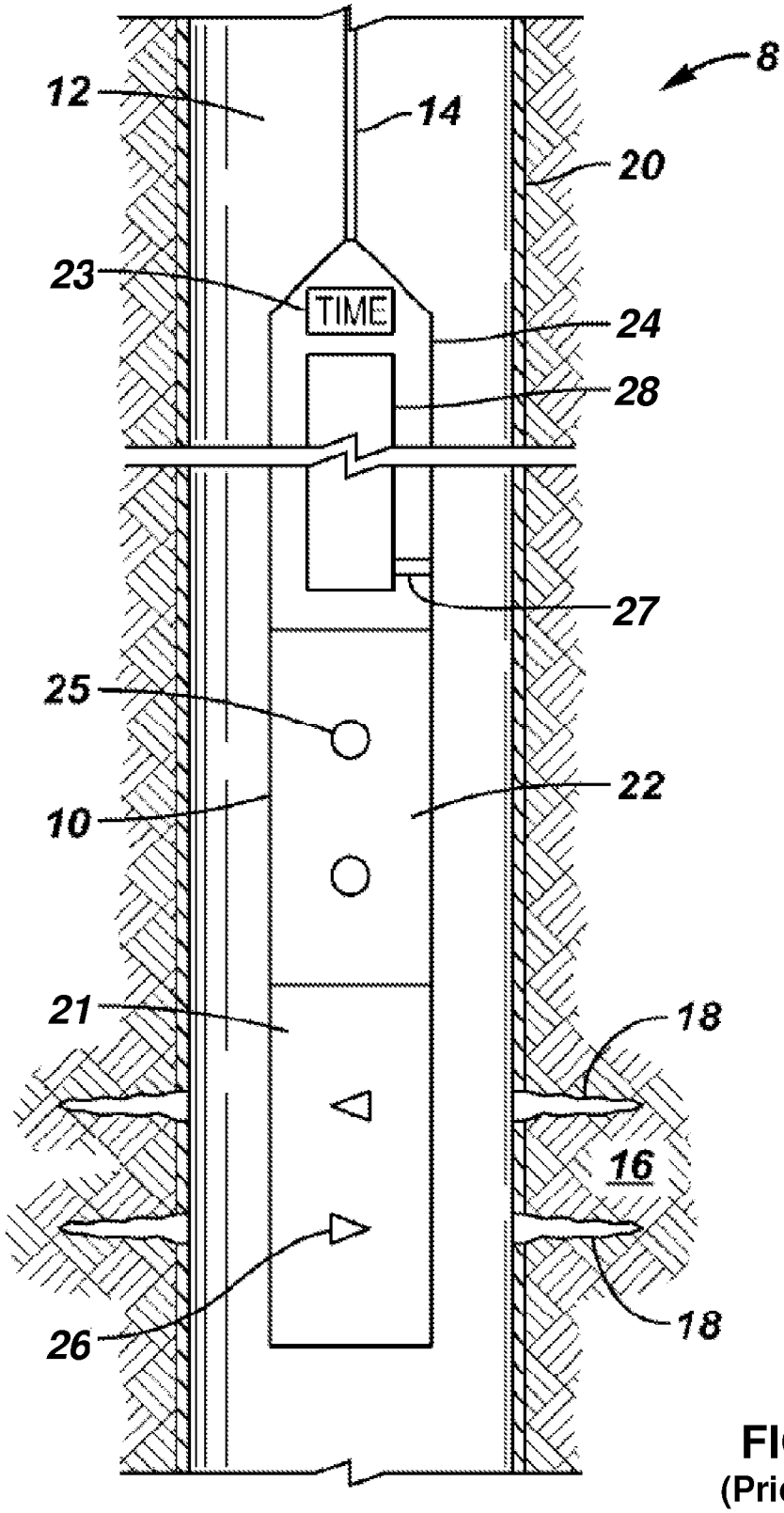
FIG. 1 (Prior Art)
FIG. 1 shows a schematic illustrating a conventional downhole assembly for perforation and completion operations.
Figure 2:
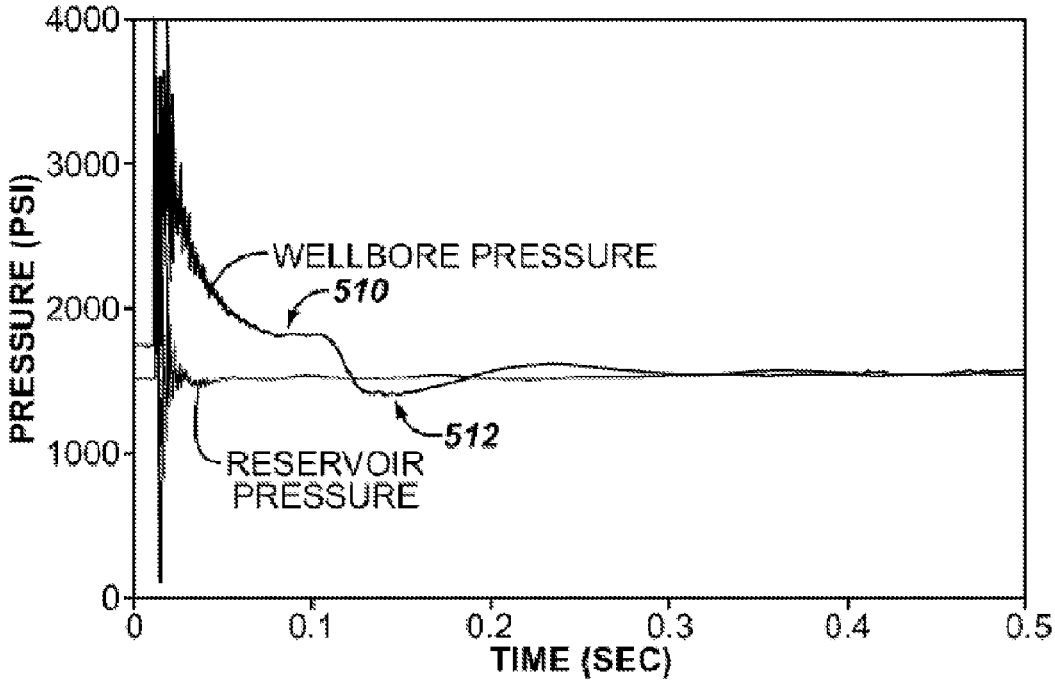
FIG. 2 (Prior Art)
FIG. 2 shows a chart illustrating pressure changes (both wellbore pressures and reservoir pressures) immediately following detonation of a shape charges.

FIG. 2 shows a chart illustrating an example of pressure changes in the wellbore and reservoir immediately after firing of a perforation gun. In this example, the wellbore pressure starts overbalanced right after detonation. The wellbore pressure subsequently decreases but remains overbalanced (shown as 510). This may be followed by a condition, in which the wellbore pressure may drop further such that an underbalance condition is created (shown as 512). This underbalance may be induced, for example, by activation of a surge tool (shown as 10 in FIG. 1). Later, the wellbore pressure may rebound to provide a transient overbalance. Finally, the wellbore pressure and reservoir pressure are balanced when equilibrium is established.

Embodiments relate to shaped charges that can provide overbalance upon detonation. The overbalance would help generate deeper and/or tunnels into the formation. The shaped charges in accordance with embodiments may include reactive materials that would react to generate heat that increases the pressure transiently. Such reactive materials, for example, may include elements like Ti, Al, Mg, Zn, Sn, B, Li, etc., and other elements, oxidizers (e.g., C, $KClO_4$, $KClO_3$, $KNO_3$, etc.) explosives, propellants or a combination of them into the shaped charges. The dynamic pressure generated from such shaped charges, due to heat released from the reactions of these materials, can help generate deeper and/or larger perforations.

Titanium (Ti) has been used in liners of shaped charges. Perforations using shaped charges having liners made with Ti metal powder (e.g., Astros Silver 3106 RDX) have been found to produce deeper and larger perforation tunnels in Sandstone, Carbonate and Coal formations regardless of the stress conditions, as compared with that without Ti powder included in the liner. In addition, results obtained from coal shots in the flow lab also show that shaped charges with liners made with Ti powder give rise to better productivity.

However, results obtained from sandstone and carbonate shots in the flow lab show that Astros Silver 3106 RDX shaped charges with Ti in the liner can damage the perforation tunnels by generating much higher dynamic pressure than that produced by the charges with non-reactive liners.

Field test results in coal bed methane (CBM) show that Astros Silver 3106 RDX shaped charges can significantly lower breakdown pressure when the gun is around liquid and helps the dewatering process, which will lead to higher productivity. However, in a CBM field test with gas in the wellbore, Astros Silver 3106 shaped charges did not show significant improvement. One possible explanation is that the dynamic pressure generated by the shaped charges tends to dissipate very quickly in gas, thus, having little impact on the formation.

The use of reactive material to enhance the explosive pressure is not limited to Ti. For example, aluminized explosives have been used to enhance over pressure in air to enhance the effectiveness of harming enemy personnel.

Embodiments use these and similar reactive materials (e.g., Ti, Al, etc.) in shaped charges to generate a large amount of heat upon detonation. The generated heat would result in increased pressures in wellbores to create overbalance immediately after detonation. As noted above, overbalance may help produce deeper and wider perforation tunnels.

Figure 3:
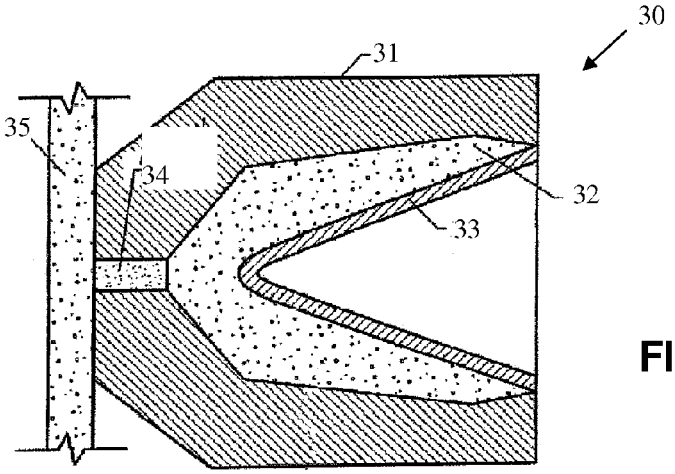
FIG. 3 shows a shaped charge for use in a perforation operation in accordance with one embodiment.

FIG. 3 shows a shaped charge 30 in accordance with embodiments includes a casing (cup-shaped casing) 31 and a liner 33, which form a cavity for holding an explosive 32. The casing 31 acts as a containment vessel designed to hold the detonation force of the detonating explosion long enough for a perforating jet to form.

The explosive charge (explosive) 32, contained between the inner wall of the cup-shaped casing 31 and liner 33, is in contact with a primer column 34 (or other ballistic transfer element), which links the main explosive charge 32 to a detonating cord 35. Examples of explosives 32 that may be used in the various explosive components (e.g., explosive charges 32, primer column 34, detonating cord 35, and boosters) include RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

To detonate a shaped charge, a detonation wave traveling through the detonating cord 35 initiates the primer column 34 when the detonation wave passes by, which in turn initiates detonation of the main explosive charge 32 to create a detonation wave that sweeps through the shaped charge. The liner 33 collapses under the detonation force of the main explosive charge.

In accordance with some embodiments, the explosive 32 may contain reactive materials that can react upon detonation and generate heat. Such reactive materials, for example, may include elements, such as Ti, Al, Mg, Zn, Sn, B, Li, etc., oxidizers (e.g., C, $KClO_4$, $KClO_3$, $KNO_3$, etc.), explosives, propellants, or a combination thereof.

By mixing Ti, Al, Mg, Zn, Sn, B, Li, etc. directly with the main explosive 32 or other oxidizers (e.g., C, $KClO_4$, $KClO_3$, $KNO_3$, etc.) inside shaped charges, the dynamic pressure may be significantly increased upon detonation due to the large amount of heat released from the reactions involving these materials. For example:

$$Ti+O_2 \rightarrow TiO_2 \text{ (19.7 KJ/gm Ti)}$$

$$2Al+3O_2 \rightarrow Al_2O_3 \text{ (62 KJ/gm Al)}$$

$$Ti+C \rightarrow TiC \text{ (3.12 KJ/gm Ti)}$$

$$4Al+3C \rightarrow Al_4C_3 \text{ (2 KJ/gm Al)}$$

The oxidizing agents may be provided by the detonation products and/or the oxidizers used.

In accordance with embodiments, the explosive 32 containing RDX or HMX may be mixed with a suitable amount of a reactive material, e.g., from a few % up to 10%, 20%, 30%, 40%, 50%, 60% or more of Ti, Al, or other reactive metal powders or flakes. Such explosives can increase the dynamic pressure inside the gun, and, thus, significantly increasing the wellbore pressure. The finer the reactive material powders or flakes, the faster these materials would react. For example, for fast reactions, the particle sizes of the reactive material powders or flakes are preferably ranging from a few microns to a few tens of microns.

Figure 4:
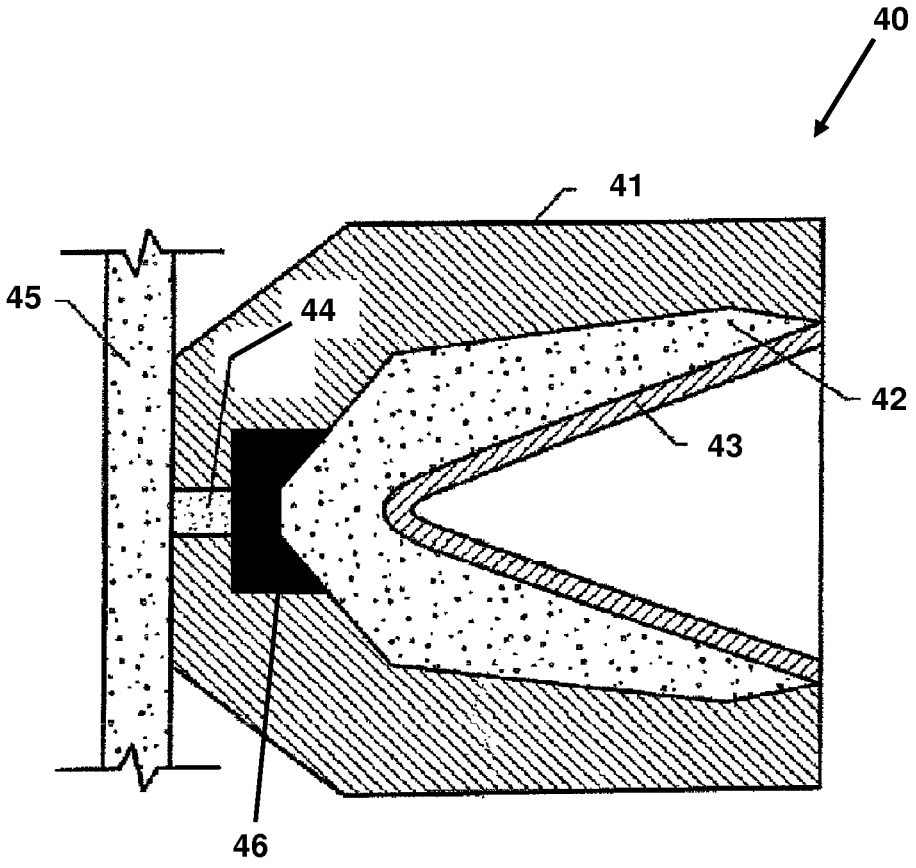
FIG. 4 shows a shaped charge for use in a perforation operation in accordance with one embodiment.

In addition to mixing with the explosives, the reactive materials also may be packed separately from the explosive. For example, FIG. 4 shows an example in accordance with embodiments. Similar to the shaped charge shown in FIG. 3, the shaped charge 40 includes an outer casing (a cup-shaped casing) 41, the main explosive charge (explosive) 42, a liner 43, a primer column 44, and a detonating cord 45. However, in this embodiment, the shaped charge 40 also includes a wave shaper 46, which contains the reactive materials. Upon detonation, the reactive materials in the wave shapers would generate a large amount of heat to increase the pressure of the explosion waves.

The wave shaper 46 may contain reactive materials, such as metal powders of Ti, Al, Mg, Zn, Sn, B, Li, etc., oxidizers (e.g., C, $KClO_4$, $KClO_3$, $KNO_3$, etc.), explosives, propellants, or a combination thereof. The wave shaper 46 may be composed of (100% or lower %) a reactive material, i.e., metal powder, a mixture of metal powder and explosives, or a mixture of metal and oxidizing agents (e.g., C, $KClO_4$, $KClO_3$, $KNO_3$, etc.). The specific shape of the wave shaper 46 may be modified to achieve a desired performance. In addition, the wave shaper 46 may be disposed at other locations inside the casing of a shaped charge. For example, the wave shaper 26 may be coated on the inside surface of the casing of a shaped charge (the entire surface or partial surface of an internal volume defined by the casing and the liner). One skilled in the art would appreciate that the designs of wave shapers may be varied based on the desired effectiveness and other considerations (e.g., the amount of heat generation desired, ease of engineering, etc.).

Wave shapers in accordance with embodiments of the invention may be applied to regular shaped charges (regardless of steel casing or zinc casing, and any kind of liner) to increase the magnitudes of dynamic pressures in the wellbores. The wave shapers preferably are manufactured and kept symmetric with respect to the configurations of the shaped charges.

Furthermore, parameters, such as amount, shot density, gas release hole etc., of the shaped charges and gun systems may be designed to avoid a potential hazard, e.g., splitting perforation gun due to the high pressure inside the gun. One skilled in the art would know how to fine tune these parameters.

Figure 5:
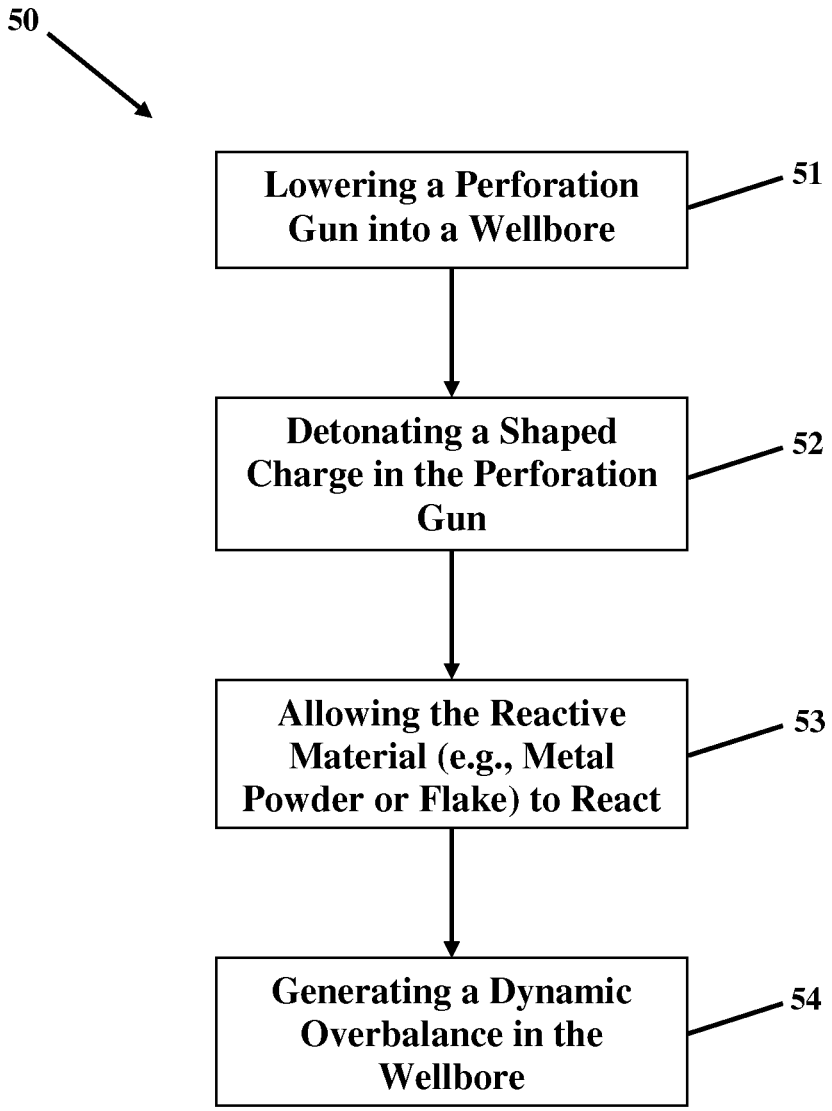
FIG. 5 shows a method for perforating a well in accordance with one embodiment.

Some embodiments of the invention relate to methods for perforation using a shaped charge of the invention. For example, FIG. 5 shows a method in accordance with one embodiment of the present invention. A method 50 for generating a dynamic overbalance inside a wellbore include the steps of: disposing a perforation gun into a wellbore (step 51). The perforation gun has one or more shaped charges, which contain elements, such as Ti, Al, Mg, Zn, Sn, B, Li, etc., and other elements, oxidizers (e.g., C, KClO4, KClO3, KNO3 etc.), explosives, propellants, or a combination thereof inside the charge casing.

The perforation gun is subsequently fired to create one or more perforations and perforation tunnels (step 52). Then, the metal powder or flake is allowed to react with the explosive or other elements, oxidizers, explosives, propellants, or a combination thereof (step 53). As a result, a large amount of heat is released from these reactions, as described above. This large amount of heat generates dynamic overbalance inside the wellbore (step 54). The dynamic overbalance may help generate deeper and longer perforating tunnels, which in turn may enhance pre-fracturing by lowering the resistance to fracturing and acid treatment applications in all types of formations, such as Sandstone, Carbonate and Coal.

Advantages of embodiments may include one or more of the following. The shaped charges contain reactive metal powder or flake that can react with explosives and/or oxidizers. The large amount of heat generated by reactions involving these reactive materials generates a dynamic overbalance in the wellbore, regardless if the perforation gun is surrounded by gas, water, or oil. When any application requires dynamic overbalance, these shaped charges will be useful in most, if not all, wellbore formations including gas in the wellbore of CBM. Thus, the shaped charges according to preferred embodiments provide a quick way to introduce one-fits-all shaped charges and their applications not only in the fracturing market in all formations.

While examples have been described with respect to a limited number of preferred embodiments, those skilled in the art, having benefit of this disclosure, will appreciate that other embodiments can be devised which do not depart from the scope of the claims herein and any subsequent related claims. Accordingly, the eventual scope of patent protection should not be limited only by the attached claims.

What is claimed is:

1. A method comprising:

disposing a perforation gun in a wellbore; and detonating a shaped charge in the perforation gun with a main explosive thereof that is disposed between a liner and a casing of the charge;

exposing reactive material of a separately packed wave shaper to the wellbore, the wave shaper located within the casing and between and interfacing each of a primer and the main explosive prior to said detonating, the reactive material selected from a group consisting of a metal and a metalloid with an oxidizing agent;

permitting the exposed reactive material to undergo a heat generating reaction upon said exposure;

allowing the heat generating reaction to increase pressure in the wellbore for a dynamic overbalance condition thereat; and forming a perforation from the detonating of the main explosive, the perforation of enhanced character into a formation adjacent the wellbore during the overbalance condition.

2. The method of claim 1, wherein the one of the metal and the metalloid of the reactive material is selected from the group consisting of Ti, Al, Mg, Zn, Sn, B, and Li.

3. The method of claim 1, wherein the explosive is RDX, HMX, or a mixture thereof.

4. The method of claim 1, wherein the oxidizing agent is at least one selected from the group consisting of C, $KClO_4$, $KClO_3$, and $KNO_3$.

5. The method of claim 1, wherein the wave shaper comprises a mixture of the reactive material and an explosive.

6. The method of claim 5, wherein the oxidizing agent is at least one selected from the group consisting of C, $KClO_4$, $KClO_3$, and $KNO_3$.

7. The method of claim 1, wherein the enhanced character of the perforation is an enhanced character of one of depth and width of the perforation.

* * * * *